US008166897B2

(12) United States Patent
Bowers et al.

(10) Patent No.: US 8,166,897 B2
(45) Date of Patent: May 1, 2012

(54) ADJUSTMENT DEVICE FOR ADJUSTING THE HEIGHT OF ROLLER SUPPORT MEMBERS OF A QUILTING FRAME

(76) Inventors: Kathryn L. Bowers, Kelso, WA (US); James E. Bowers, Kelso, WA (US)

( * ) Notice: Subject to any disclaimer, the term of this patent is extended or adjusted under 35 U.S.C. 154(b) by 704 days.

(21) Appl. No.: 12/403,422

(22) Filed: Mar. 13, 2009

(65) Prior Publication Data

US 2009/0229389 A1 Sep. 17, 2009

Related U.S. Application Data

(60) Provisional application No. 61/036,279, filed on Mar. 13, 2008.

(51) Int. Cl.
*D05B 11/00* (2006.01)

(52) U.S. Cl. ..... 112/119

(58) Field of Classification Search ..... 112/475.08, 112/117–119, 103, 470.12, 470.3, 470.33, 112/304–307

See application file for complete search history.

(56) References Cited

U.S. PATENT DOCUMENTS

| | | | | |
|---|---|---|---|---|
| 3,960,095 | A * | 6/1976 | Story | 112/118 |
| 4,192,241 | A * | 3/1980 | Reed et al. | 112/117 |
| 5,913,277 | A * | 6/1999 | Resta | 112/470.12 |
| 6,631,688 | B1 * | 10/2003 | Maag | 112/118 |
| 6,792,884 | B1 * | 9/2004 | Barrus | 112/475.08 |
| 6,951,178 | B2 * | 10/2005 | Watts | 112/118 |
| 7,011,031 | B1 * | 3/2006 | Bradley | 112/119 |
| 7,895,671 | B2 * | 3/2011 | Salomon | 2/161.2 |

* cited by examiner

*Primary Examiner* — Danny Worrell, Jr.
(74) *Attorney, Agent, or Firm* — James Ray & Assoc

(57) ABSTRACT

An adjustment device for use with a quilting frame having end portions and roller supports height adjustably connected thereto via nut and bolt securing mechanism includes a pair of base members connectable to predetermined sides of such roller supports and having threaded apertures disposed therethrough running from top to bottom. A securing mechanism secures such base members to such roller supports. Elongated threaded rod members are rotatably disposed within such threaded apertures. A mechanism for rotating such rod members is operably connected to each top end thereof for gripping by a user and rotating when such nut and bolt are loosened such that such bases and such roller supports are raised and lowered. Protective members are connected to at least one of bottom ends of such rod members, predetermined locations on end portions of such quilting frame, and a combination thereof for protecting such quilting frame from being damaged.

11 Claims, 6 Drawing Sheets

ADJUSTMENT DEVICE FOR ADJUSTING THE HEIGHT OF ROLLER SUPPORT MEMBERS OF A QUILTING FRAME

CROSS REFERENCE TO RELATED APPLICATION

This patent application is related to and claims priority from U.S. Provisional Patent Application Ser. No. 61/036,279 filed Mar. 13, 2008.

FIELD OF THE INVENTION

The present invention relates, in general, to accessories for use with quilting frames and, more particularly, this invention relates to a device for enabling a user to quickly and easily raise and lower roller supporting portions of a quilting frame.

BACKGROUND OF THE INVENTION

Prior to the conception and development of the present invention, quilting machines, as are generally well known in the prior art, have been used to make quilts. Unfortunately, quilts are large and can be difficult to handle as they are being quilted. Quilting frames include rollers for receiving and holding the layers of a quilt not being quilted. Such rollers are supported by roller support members of such quilting frames. However, the size of the portion being supported by such rollers depends on where on such quilt a quilter is sewing therefore the particular portion supported by a roller may be quite small or quite large. In order to accommodate the various sized portions, the roller support members of the quilting frame are usually adjustable in height but the process to adjust such height is complicated and can be very uncomfortable or even impossible if an individual is unable to bend down, has arthritis, lacks strength in his or her hands and arms, becomes dizzy upon bending over, etc., since the process for adjusting the height of the roller support members includes loosening a first series of knobs, then on some frames locating a second series of adjustment knobs under the frame and turning them until the desired adjustment is made, then tightening the first series of knobs to secure the adjustment.

Specifically of interest to the present invention are the following: Bradley, U.S. Pat. No. 7,011,031, discloses a quilting machine which includes a table having a carriage for supporting a sewing machine on the table and translating the sewing machine in two axes, a quilting rack for supporting one or more layers of fabric in a substantially planer orientation relative to the sewing machine, and foldable legs. The quilting rack is suspended above the table on a rotatable vertical support, and is adjustable without tools for positioning the fabric in orientation for machine quilting.

Barrus, U.S. Pat. No. 6,792,884, discloses a quilting apparatus and method for guiding a sewing machine. The apparatus may include an adjustable quilting frame and a carriage assembly that supports the sewing machine. The quilting frame is mounted relative to a working surface and retains one or more fabric layers in a substantially planar orientation. The quilting frame includes support members acting as spools to retain the fabric layers and having locking mechanisms for maintaining tension in the fabric layers. The support members have an adjustable length to accommodate various fabric sizes and to accommodate the arbitrary dimensions of the working surface. The height of the quilting frame may also be adjusted.

Maag, U.S. Pat. No. 6,631,688, discloses a quilting rack for sewing machines comprising a U-shaped rectangular metal frame supporting a wheeled bottom or queen carriage for side to side translation of a wheeled upper king carriage capable of forward and rearward translation of the sewing machine it is carrying. Three rollers supply, tension and load the quilt for sewing patterns guided by a laser pointer and a template.

None of the above references provide the benefits attenuate the present invention.

SUMMARY OF THE INVENTION

The present invention provides an adjustment device for use in combination with a quilting frame having a pair of end portions each including at least one aperture disposed therethrough and such quilting frame also having at least one pair of roller support members each including an elongated aperture disposed therethrough, each one of such roller support members being height adjustably connected to a respective end portion via a nut and bolt securing means, such bolt being disposed through such aperture and such elongated aperture and engaged with such nut, such nut and bolt being engageable with each other at a plurality of locations along such elongated aperture such that such roller support members may be raised and lowered. Such adjustment device includes a pair of base members manufactured from a predetermined material and having a predetermined size and a predetermined shape. Such base members are each connectable to predetermined sides of such roller support members at predetermined locations thereon. Such base members each further include a threaded aperture disposed therethrough running from a top portion thereof through a bottom portion thereof. A first securing means secures such base members to such roller support members. A pair of elongated threaded rod members are each rotatably disposed within such threaded apertures such that such rod members are substantially parallel to such roller support members. A means for rotating such rod members is operably connected to a top end of each of such respective rod members for gripping by a user and selectively rotating such rod members when such nut and bolt are in a loosened position such that such bases and such roller support members are raised and lowered according to the direction which such rod members are rotated. At least one pair of protective members are operably connected to at least one of bottom ends of such respective rod members, predetermined portions of such end portions of such quilting frame, and a combination thereof, for at least one of receiving such bottom ends at least one of therein, thereon, and a combination thereof, protecting such quilting frame from being damaged by such bottom ends of such rod members, and a combination thereof.

OBJECTS OF THE INVENTION

It is, therefore, one of the primary objects of the present invention to provide a device for use with a quilting frame which will enable a user to quickly and easily raise and lower roller support members of such quilting frame.

Another object of the present invention is to provide a device for selectively raising and lowering roller support members of a quilting frame, such device including a crank handle which can be easily turned by such user from above such quilting frame to raise and lower such roller support members.

Still another object of the present invention is to provide an adjustment device for use with a quilting frame for enabling a user to adjust the height of roller support members of a quilting frame via releasing bolt type securing means connecting such roller support members to end portions of such quilting frame and thereafter turning crank handles suspended above such quilting frame, such crank handles being part of such adjustment device and each crank handle being connected to an elongated rod which is turned by such crank handle, such elongated rods being operably connected to such roller support members for raising and lowering such roller support members according to which way such crank handles are turned.

Yet another object of the present invention is to provide an adjustment device which can be used to adjust the height of a roller support member attached to a quilting frame without requiring a user of such device to bend over, down, and underneath such quilting frame.

An additional object of the present invention is to provide an adjustment device for use with a quilting frame that is easy to use and can be fitted on many quilting frames having height adjustable roller support members.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
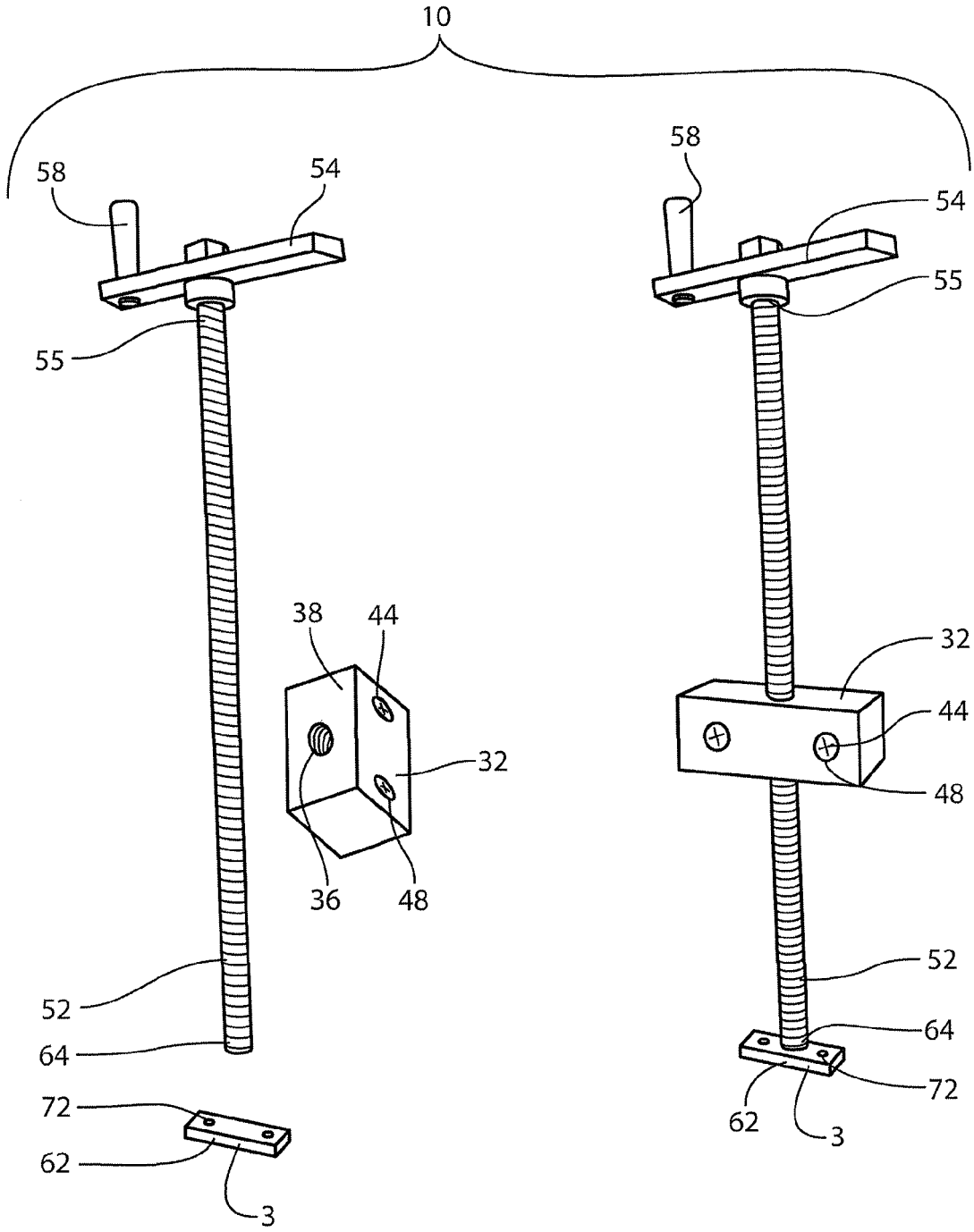
FIG. 1 is a partial perspective view of the invention according to one embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly to FIGS. 1-6.

The present invention provides an adjustment device, generally designated 10, for use in combination with a quilting frame, generally designated 20, having a pair of end portions 12 each including at least one aperture (not shown) disposed there through and such quilting frame 20 also having at least one pair of roller support members 16 each including an elongated aperture 18 disposed therethrough; each one of such roller support members 16 being height adjustably connected to a respective end portion 12 via a nut and bolt securing means 22, such bolt of such nut and bolt securing means 22 being disposed through such aperture and such elongated aperture 18 and engaged with such nut, such nut and bolt being engageable with each other at a plurality of locations along such elongated aperture 18 such that such roller support members 16 may be raised and lowered. Most quilting frames also include knob members 7 engaged with such nut and bolt securing means 22.

Such adjustment device 10 includes a pair of base members 32 manufactured from a predetermined material and having a predetermined size and a predetermined shape. Such base members 32 are each connectable to predetermined sides of such roller support members 16 at predetermined locations thereon. Such base members 32 each further include a threaded aperture 36 disposed there through running from a top portion 38 thereof through a bottom portion (not shown) thereof. It is presently preferred that such predetermined material is at least one of metal, plastic, wood, and a combination thereof. It is presently most preferred that such predetermined material is plastic.

A first securing means 44 secures such base members 32 to such roller support members 16. It is presently preferred that such first securing means 44 is a screw type securing means 48.

A pair of elongated threaded rod members 52 are each rotatably disposed within such threaded apertures 36 such that such rod members 52 are substantially parallel to such roller support members 16. Referring to FIG. 1, one of such rod members is shown outside of such base member for purposes of illustration. It is presently preferred that such elongated rod members 52 are at least one of elongated screw members and elongated bolt members. It is presently most preferred that such elongated rod members 52 are elongated bolt members.

A means 54 for rotating such rod members 52 is operably connected to a top end 55 of each of such respective rod members 52 for gripping by such user and selectively rotating such rod members 52 when such nut and bolt securing means is in a loosened position such that such base members 32 and such roller support members 16 are raised and lowered according to the direction which such rod members 52 are rotated. It is presently preferred that such means 54 for rotating such rod members 52 is at least one of a knob and a crank handle. It is presently most preferred that such means for rotating such rod members 52 is a crank handle 58.

Figure 2:
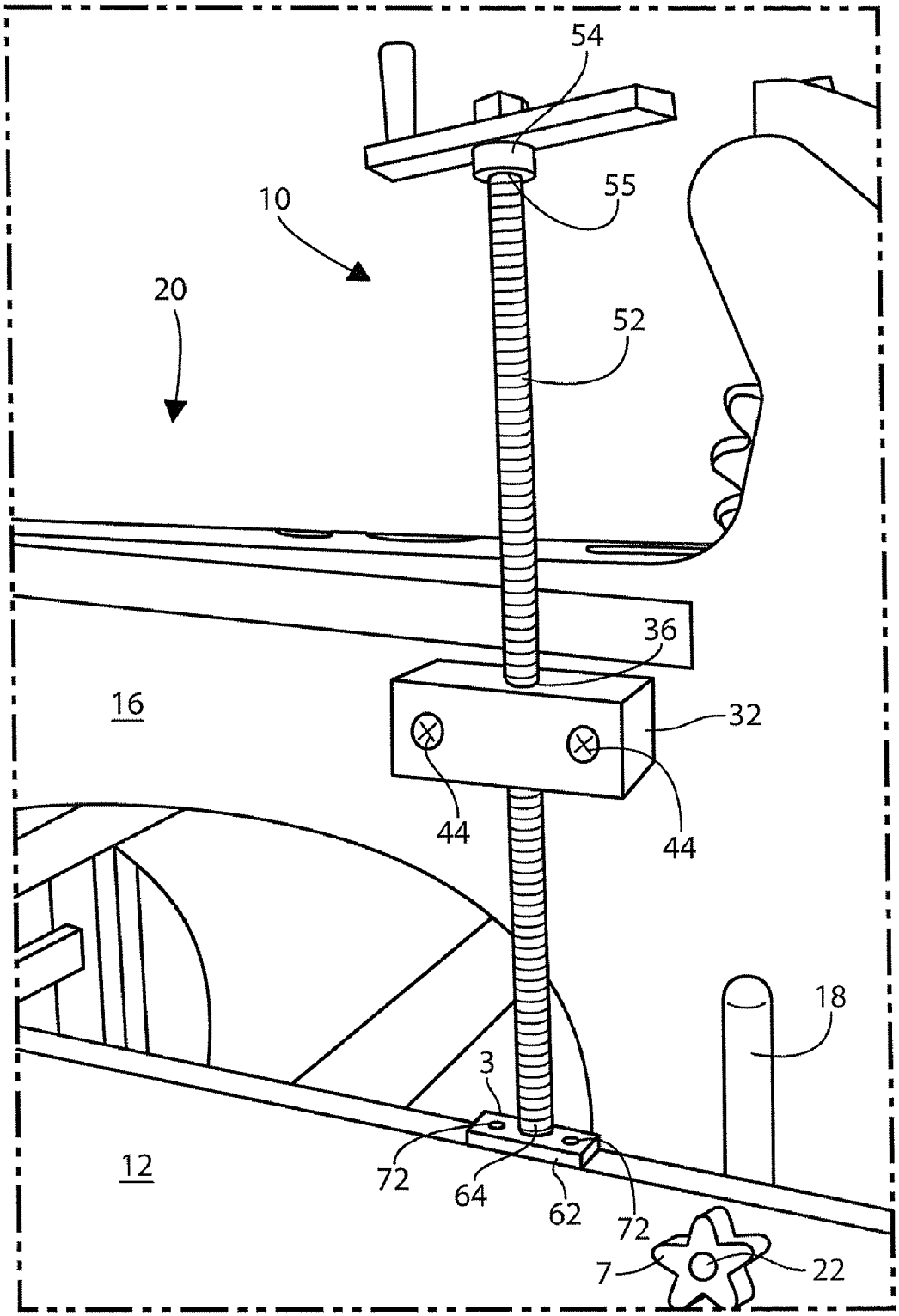
FIG. 2 is a partial perspective view of the invention according to one embodiment of the invention; the invention is depicted as being attached to a quilting frame.
Figure 3:
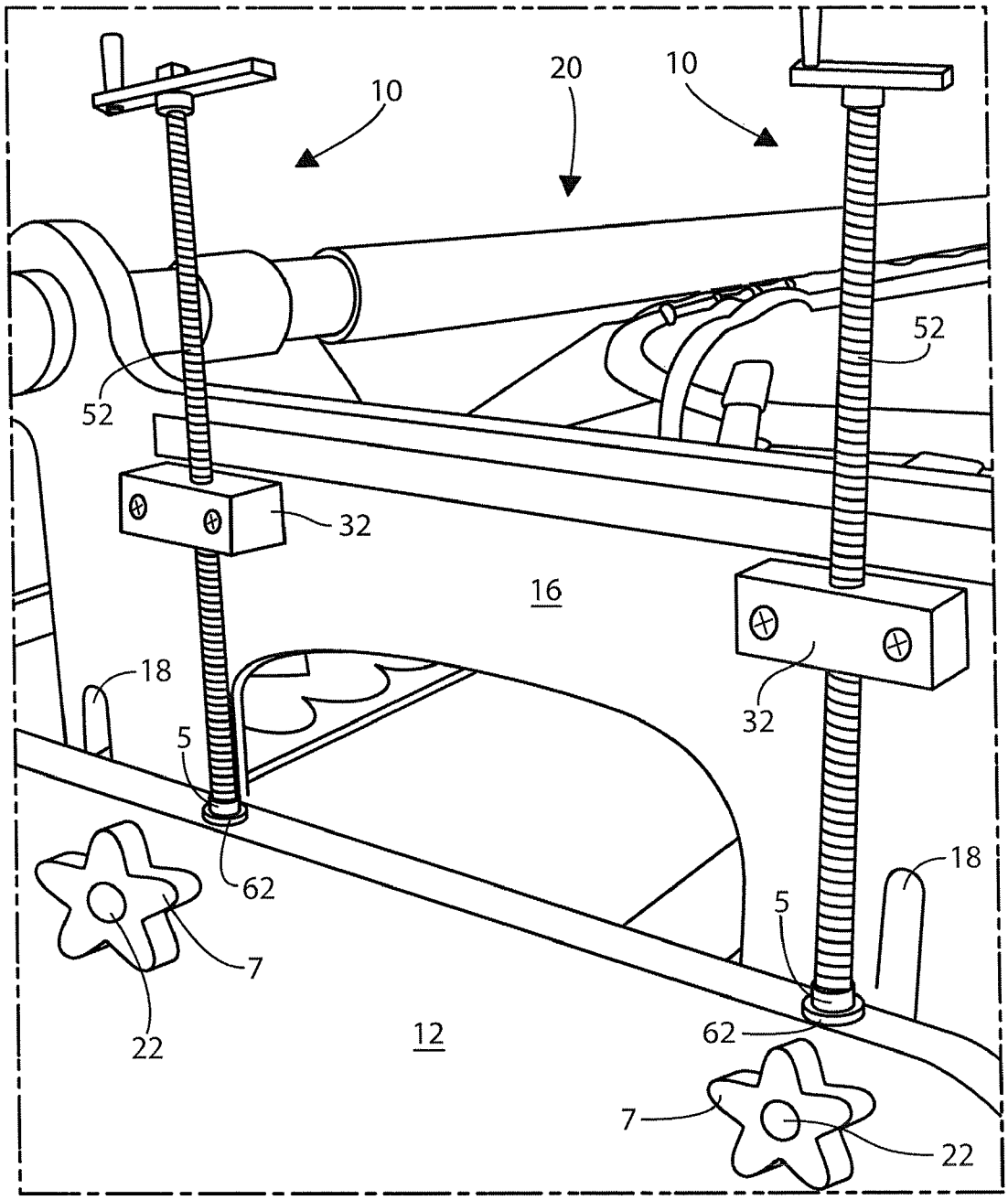
FIG. 3 is a partial perspective view of the invention according to one embodiment of the invention; in this figure a partial perspective view is provided of one half of each of a pair of such adjustment devices each half being attached to the same end portion of such quilting frame. Many quilting frames will support the use of a pair of such adjustment devices.
Figure 4:
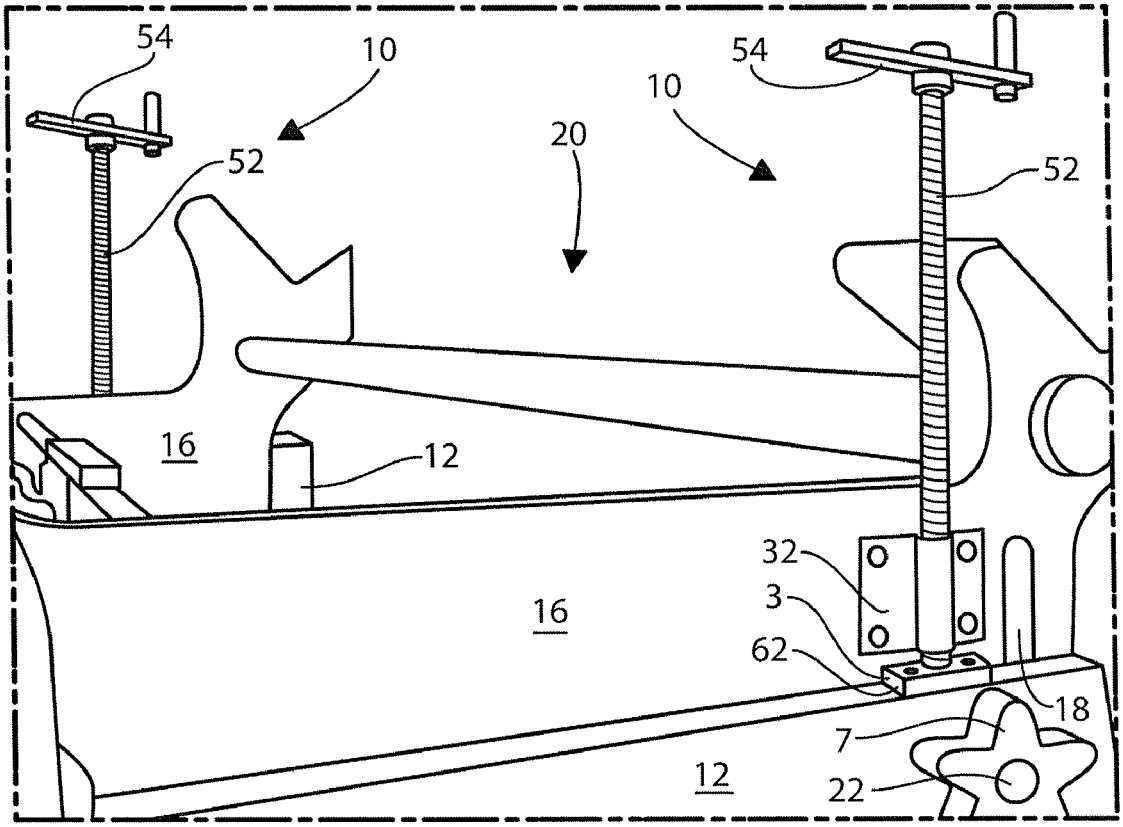
FIG. 4 is a partial perspective view of the invention according to one embodiment of the invention.
Figure 5:
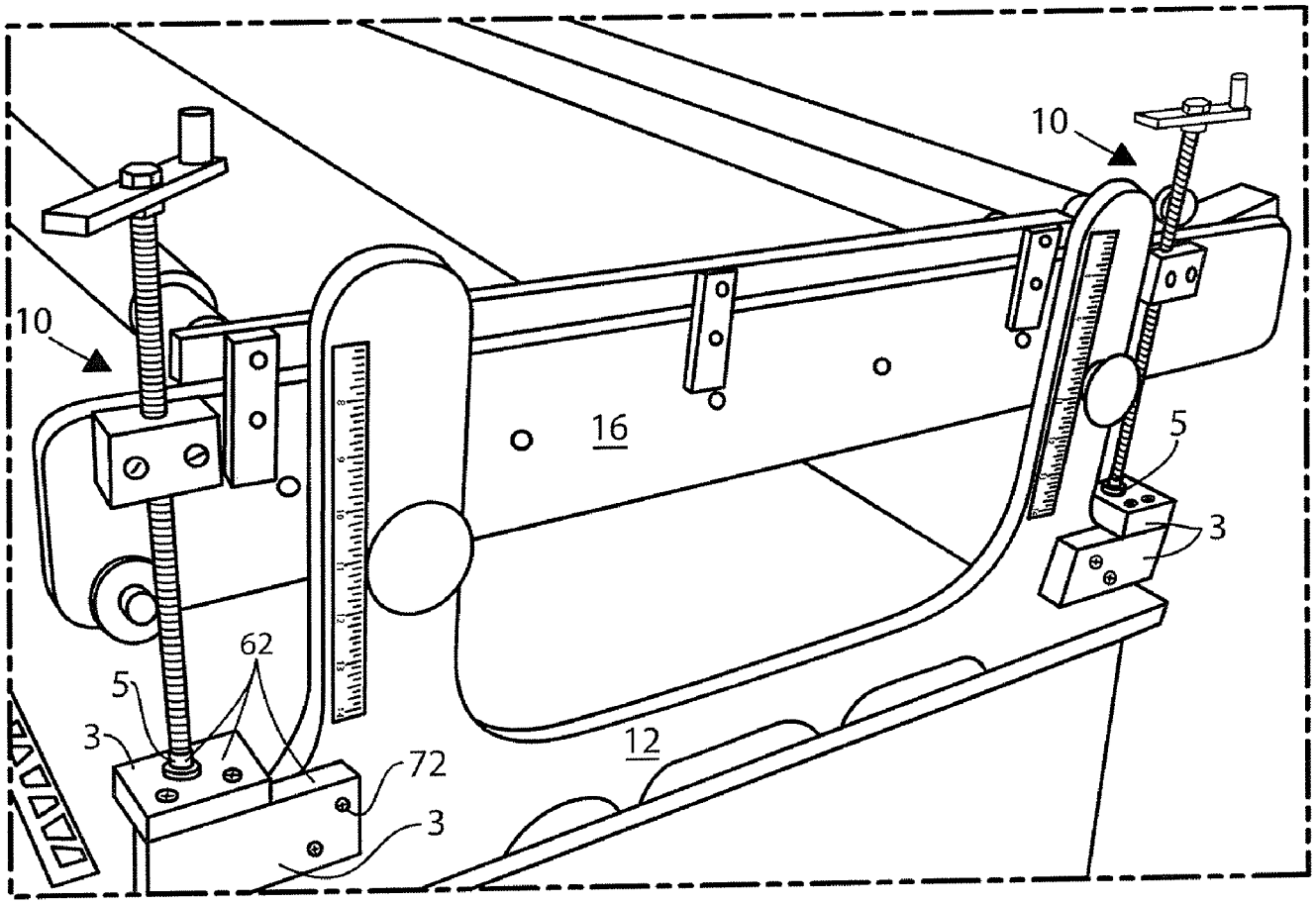
FIG. 5 is a partial perspective view of the invention according to one embodiment of the invention.

At least one pair of protective members 62 are operably connected to at least one of bottom ends 64 of each of such respective rod members 52, predetermined portions of such end portions 12 of such quilting frame 20, and a combination thereof, for at least one of receiving such bottom ends 64 at least one of therein, thereon, and a combination thereof, protecting such quilting frame 20 from being damaged by such bottom ends 64 of such rod members 52, and a combination thereof. It is presently preferred that such protective members 62 are at least one of sleeve members, swivel sockets, hub members, platform members, end cap members and a combination thereof. For example, as shown in FIGS. 1, 2, and 4 such protective members 62 may be platform type members 3; as shown in FIG. 3, such protective members may be end caps 5; as shown in FIG. 5 such protective members 62 may a combination of end cap members 5 and platform type members 3, etc. It is further presently preferred that such adjustment device 10 includes a second securing means 72 for securing such protective members 62 to such at least one of such bottom ends 64 of each of such respective rod members 52, such predetermined portion of such end portions 12 of such quilting frame 20, and a combination thereof. It is presently preferred that such second securing means 72 is a screw type securing means.

Figure 6:
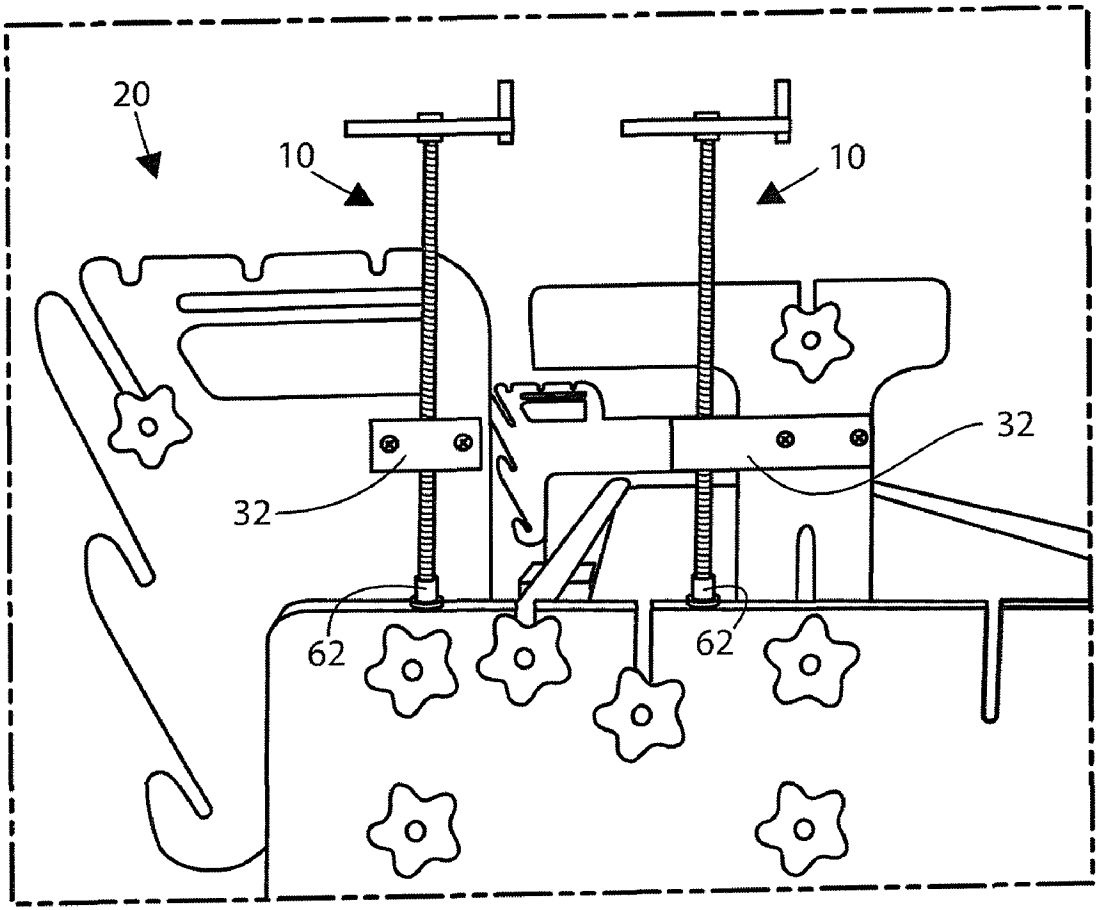
FIG. 6 is a partial perspective view of the invention according to one embodiment of the invention.

As illustrated in FIG. 4, the adjustment device is meant to include each of its two halves being attached on opposite ends of such frame member such that roller supporting members attached to each end portion of such frame member may be easily and quickly raised and lowered. However, some frame members will accommodate the use of two of such adjustment devices at the same time as illustrated in FIGS. 3, 5, and 6. In such cases while the two halves of such adjustment device 10 are opposite each other, each half will also be attached to the same end of such quilting frame as half of a second adjustment device 10.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

We claim:

1. An adjustment device for use in combination with a quilting frame having a pair of end portions each including at least one aperture disposed therethrough and such quilting frame also having at least one pair of roller support members each including an elongated aperture disposed therethrough, each one of such roller support members being height adjustably connected to a respective end portion via a nut and bolt securing means, such bolt being disposed through such aperture and such elongated aperture and engaged with such nut, such nut and bolt being engageable with each other at a plurality of locations along such elongated aperture such that such roller support members may be raised and lowered, said adjustment device comprising:

a. a pair of base members manufactured from a predetermined material and having a predetermined size and a predetermined shape, said base members each being connectable to predetermined sides of said roller support members at predetermined locations thereon, said base members each further including a threaded aperture disposed therethrough running from a top portion thereof through a bottom portion thereof;

b. a first securing means for securing said base members to said roller support members;

c. a pair of elongated threaded rod members each being rotatably disposed within said threaded apertures such that said rod members are substantially parallel to said roller support members;

d. means for rotating said rod members operably connected to a top end of each of said respective rod members for gripping by such user and selectively rotating said rod members when such nut and bolt are in a loosened position such that said bases and said roller support members are raised and lowered according to the direction which said rod members are rotated; and e. at least one pair of protective members each one of said protective members being operably connected to at least one of a bottom end of each of said respective rod members, a predetermined portion of each of such end portions of such quilting frame, and a combination thereof for at least one of receiving said bottom ends at least one of therein, thereon, and a combination thereof, protecting such quilting frame from being damaged by said bottom ends of said rod members, and a combination thereof.

2. An adjustment means according to claim 1 wherein said means for rotating said rod members is at least one of a knob and a crank handle.

3. An adjustment means according to claim 2 wherein said means for rotating said rod members is a crank handle.

4. An adjustment device according to claim 1 wherein said predetermined material is at least one of metal, plastic, wood, and a combination thereof.

5. An adjustment device according to claim 4 wherein said predetermined material is plastic.

6. An adjustment device according to claim 1 wherein said first securing means is a screw type securing means.

7. An adjustment device according to claim 1 wherein said rod members are at least one of elongated screw members and elongated bolt members.

8. An adjustment device according to claim 7 wherein said rod members are elongated bolt members.

9. An adjustment device according to claim 1 wherein said protective members are at least one of sleeve members, swivel sockets, hub members, platform members, end cap members and a combination thereof.

10. An adjustment device according to claim 1 wherein said adjustment device further includes a second securing means for securing said protective members to said at least one of said bottom ends of each of said respective rod members, such predetermined portion of such end portions of such quilting frame, and a combination thereof.

11. An adjustment device according to claim 10 wherein said second securing means is a screw type securing means.

* * * * *